US008205712B2

(12) United States Patent
Dickie

(10) Patent No.: US 8,205,712 B2
(45) Date of Patent: Jun. 26, 2012

(54) PORTED LOUDSPEAKER ENCLOSURE WITH TAPERED WAVEGUIDE ABSORBER

(76) Inventor: Laurence George Dickie, Brighton (GB)

( * ) Notice: Subject to any disclaimer, the term of this patent is extended or adjusted under 35 U.S.C. 154(b) by 0 days.

(21) Appl. No.: 12/212,908

(22) Filed: Sep. 18, 2008

(65) Prior Publication Data

US 2009/0084624 A1 Apr. 2, 2009

(30) Foreign Application Priority Data

Sep. 21, 2007 (ZA) ..... 2007/08151

(51) Int. Cl.
*H04R 1/28* (2006.01)

(52) U.S. Cl. ..... 181/152; 181/151; 181/193; 181/199; 381/341

(58) Field of Classification Search ..... 181/151, 181/152, 156, 189, 199, 192, 193, 194; 381/338, 381/340, 341, 349, 348
See application file for complete search history.

(56) References Cited

U.S. PATENT DOCUMENTS

| | | | | | |
|---|---|---|---|---|---|
| 2,971,598 | A * | 2/1961 | Sieler | 181/152 |
| 2,975,852 | A * | 3/1961 | Chave | 381/342 |
| 3,666,041 | A * | 5/1972 | Engelhardt | 181/145 |
| 3,687,221 | A * | 8/1972 | Bonnard | 181/180 |
| 4,509,184 | A * | 4/1985 | Yanagawa | 381/308 |
| 4,524,846 | A * | 6/1985 | Whitby | 181/152 |
| 4,592,444 | A * | 6/1986 | Perrigo | 181/151 |
| 4,837,837 | A * | 6/1989 | Taddeo | 381/346 |
| 4,853,964 | A * | 8/1989 | Weckler | 381/341 |
| 5,197,103 | A * | 3/1993 | Hayakawa | 381/349 |
| 5,373,564 | A * | 12/1994 | Spear et al. | 381/352 |
| 5,675,131 | A * | 10/1997 | Saito et al. | 181/152 |
| 6,062,338 | A * | 5/2000 | Thompson | 181/152 |
| 6,104,823 | A * | 8/2000 | Tanaka | 381/345 |
| 6,356,643 | B2 * | 3/2002 | Yamagishi et al. | 381/349 |
| 6,377,696 | B1 * | 4/2002 | Nevill | 381/345 |
| 6,411,720 | B1 * | 6/2002 | Pritchard | 381/348 |
| 6,411,721 | B1 * | 6/2002 | Spindler | 381/349 |
| 6,560,343 | B1 * | 5/2003 | Kim | 381/349 |
| 6,955,241 | B2 * | 10/2005 | Thorsell et al. | 181/156 |
| 6,973,994 | B2 * | 12/2005 | Mackin et al. | 181/156 |
| 2002/0085731 | A1 * | 7/2002 | Aylward | 381/349 |
| 2007/0102232 | A1 * | 5/2007 | Geddes | 181/185 |

FOREIGN PATENT DOCUMENTS

GB 2290672 A * 1/1996

* cited by examiner

*Primary Examiner* — Jeremy Luks
(74) *Attorney, Agent, or Firm* — Nixon Peabody LLP; Jeffrey L. Costellia

(57) ABSTRACT

A loudspeaker enclosure has a first aperture in which a driver can be mounted, the driver having a first resonant frequency. A second aperture defines a port extending between the interior and the exterior of the enclosure. The port is tuned to a second resonant frequency. A sound absorbing element comprises at least one exponentially tapered horn having a mouth in communication with the interior of the enclosure. The horn has a cut-off frequency equal to or greater than the resonant frequency of the port, and preferably two to four times greater. The horn can be defined by tapering external walls of the enclosure, or by structures located within the enclosure which define a plurality of individual horns. The described enclosure combines the benefits of ported enclosures with those of enclosures employing tapered sound absorbing elements.

17 Claims, 10 Drawing Sheets

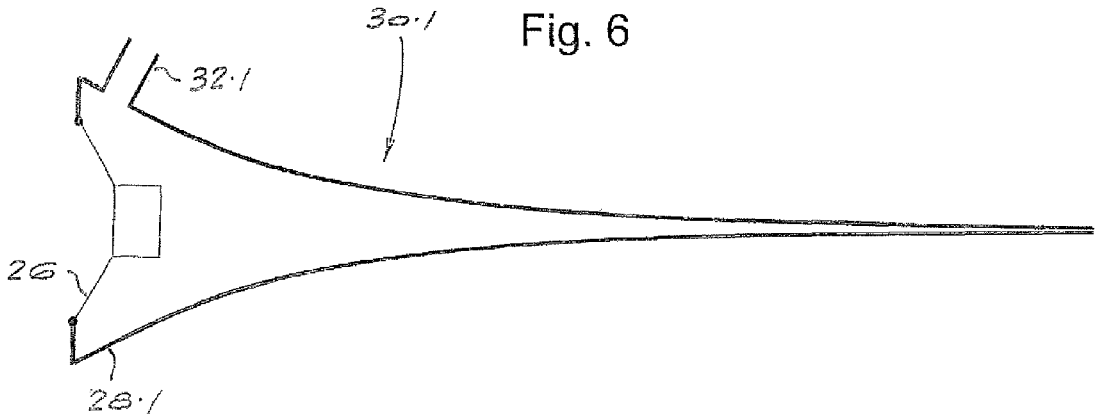
Fig. 6
Fig. 7
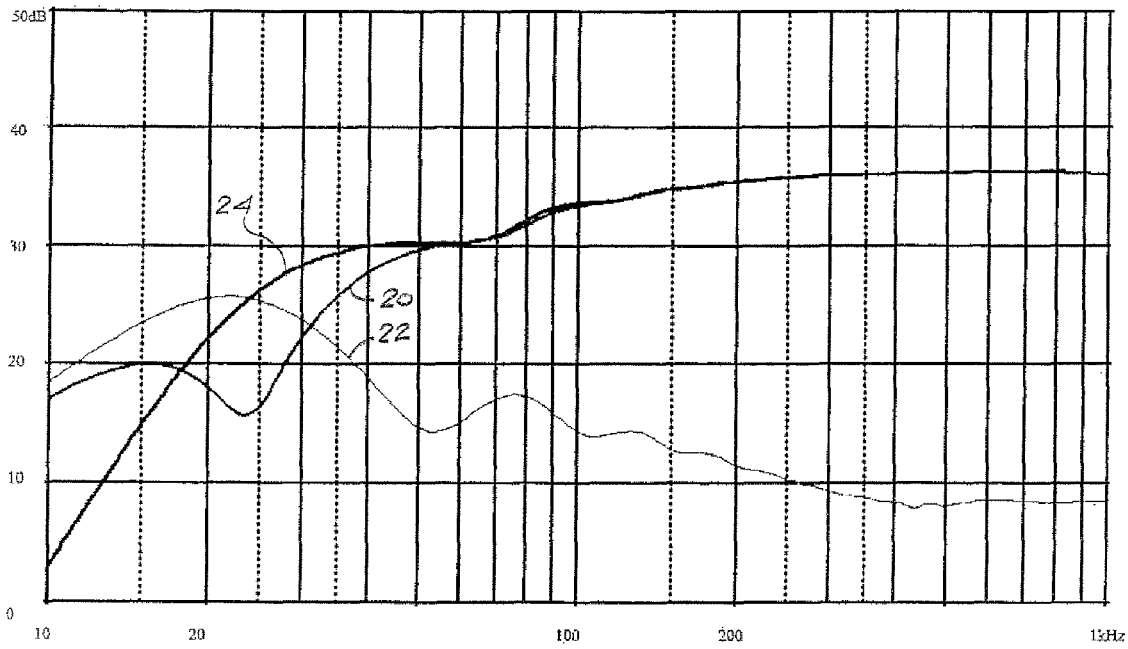

PORTED LOUDSPEAKER ENCLOSURE WITH TAPERED WAVEGUIDE ABSORBER

BACKGROUND OF THE INVENTION

This invention relates to loudspeaker enclosures, and more particularly to vented or ported loudspeaker enclosures.

The majority of loudspeaker transducers designed for use in air can be described as a piston attached to a linear motor system. An alternating electrical signal fed into the motor causes the piston or diaphragm to vibrate accordingly, so creating sound waves in the surrounding air.

As the diaphragm moves in one sense so the air on one side of the diaphragm is compressed while the air on the other side is rarefied, and vice versa. Thus, the sound waves emitted from the two sides of the diaphragm are of opposite phase. In order to prevent cancellation between the two, the transducer is normally mounted in some kind of enclosure which contains the radiation from one side of the driver. Such enclosures may be sealed or may be vented by way of a port, amongst other configurations.

At low frequencies the enclosed volume of air behaves as a simple compliance but standing waves will be excited within the enclosure at higher frequencies where the wavelengths are similar in scale to the enclosure dimensions. These resonances may then be heard superimposed on the output from the front side of the diaphragm, to the detriment of the overall fidelity of the reproduction.

The low frequency output of a loudspeaker driver may advantageously be reinforced at low frequencies by the addition of a port connecting the inside of the enclosure to the air outside. The combination of the mass of air in the port, coupled to the enclosed air spring or compliance, forms a Helmholtz resonator which would normally be tuned to a frequency somewhat lower than the low frequency resonance of the driver in an equivalent sealed enclosure, thereby extending the low frequency extension of the system. However, this arrangement tends to exacerbate the leakage of any internal standing waves to the outside world.

Absorbent material, including fibrous tangles such as long fibre wool, may be used to attenuate standing waves but does not eliminate them. Also, when such material is used in conjunction with a vented system there is a tendency for the quality of the port resonance to be deleteriously affected as the damping effect of the fibre also acts as a loss in the Helmholtz resonator.

It is an object of the invention to provide a loudspeaker enclosure that is vented or ported and which includes means for controlling standing waves.

SUMMARY OF THE INVENTION

According to the invention there is provided a loudspeaker enclosure having a first aperture in which a driver can be mounted, the driver having a first resonant frequency; a second aperture defining a port extending between the interior and the exterior of the enclosure, the port being tuned to a second resonant frequency; and a sound absorbing element comprising at least one horn having a mouth in communication with the interior of the enclosure, at least a part of said at least one horn being tapered exponentially, and said at least one horn having a cut-off frequency equal to or greater than the resonant frequency of the port.

Preferably said at least one horn has a cut-off frequency which is at least twice and preferably at least four times the resonant frequency of the port.

Said at least one horn of the sound absorbing element may be defined by an external wall or walls of the enclosure which converge according to a predetermined function.

For example, the enclosure may define a tapered structure of circular or rectangular cross section.

In another embodiment, the enclosure is circular or part-circular, with walls converging radially outwardly to define a disc-shaped enclosure with a cross section that reduces towards an outer edge thereof.

Alternatively, said at least one horn of the sound absorbing element may be defined by one or more structures positioned within the enclosure.

For example, the sound absorbing element may comprise a structure defining a plurality of individual horns arranged in a ring or planar configuration.

The second aperture defining the port may be adjacent to the first aperture in the enclosure, with a longitudinal axis parallel to an axis extending normal to the first aperture.

In other embodiments, the second aperture defining the port may have a longitudinal axis extending transversely to an axis extending normal to the first aperture.

Preferably, the second aperture defining the port is located within a primary chamber of the enclosure outside the mouth of said at least one horn, and more preferably closer to the driver than to the mouth.

In a preferred embodiment of the enclosure, the horn is coiled spirally.

Preferably, the horn has a longitudinal axis at the mouth thereof which extends transversely to an axis extending normal to the first aperture.

Further according to the invention there is provided a loudspeaker comprising a loudspeaker enclosure as defined above, and at least one driver.

Said at least one driver will generally be a low frequency driver or woofer

BRIEF DESCRIPTION OF THE DRAWINGS

FIG. 6 is a schematic side view of a loudspeaker enclosure similar to that of FIG. 4, but with an increased cut-off frequency of the exponential horn;

FIG. 7 is a frequency response graph showing the calculated performance of the arrangement of FIG. 6;

DESCRIPTION OF EMBODIMENTS

In the case of a simple closed box loudspeaker enclosure it is possible, at least theoretically, to eliminate the problem of standing waves by mounting the driver on the end of an infinitely long tube. As the tube is infinitely long there is no end to cause reflections and therefore standing waves. More practically, the tube may have finite dimensions and be filled with absorbent material. For a given volume the tube is preferably deeper than a cube (that is, somewhat elongate, with a length greater than its width or diameter) so that the sound travels through a relatively greater amount of absorbent material before reaching the end of the tube and reflecting back, hence reducing the effect of the standing waves.

If such a tube is tapered exponentially, and the absorbent material is graduated correspondingly by using it at a constant weight per unit length of the tube, the performance may be further enhanced as a result of the gradual increase in density of the absorbent material.

A horn may be defined as having a cross-sectional area A" at a distance x from an end having area A'. In the case of an exponential horn these are related by the equation:

$$A''=A'(e^{mx})$$

where m=4f π/c, in which c is the speed of sound in air and f is known as the cut-off frequency.

The exponential horn has the property that above the cut-off frequency, the acoustic impedance tends towards that of a tube of constant diameter. In the cited example the cut-off frequency is chosen to be at or below the lowest desired frequency of reproduction.

However, if the sound absorbing tube, tapered or not, is used with a port or vent, the effect of the port is found to be severely compromised by the damping effect of the absorbent material at the port frequency.

The requirement, then, is for an enclosure which is free from standing waves but which still behaves as a low-loss compliance thereby permitting the useful addition of a port to augment the low frequency performance of the loudspeaker driver.

Figure 1:
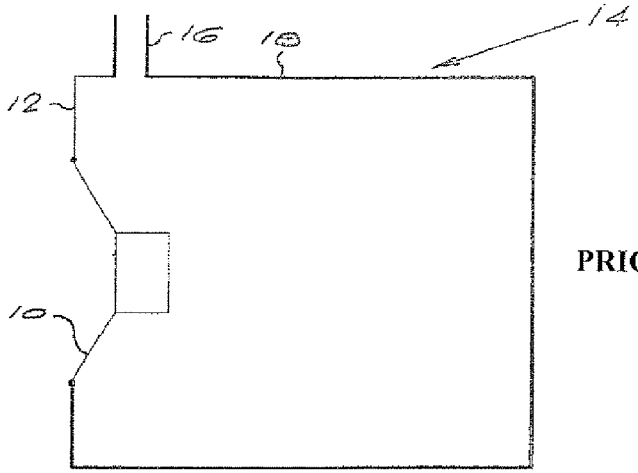
FIG. 1 is a schematic side view of a conventional ported loudspeaker enclosure used as a reference to illustrate the effect of the present invention.
Figure 2:
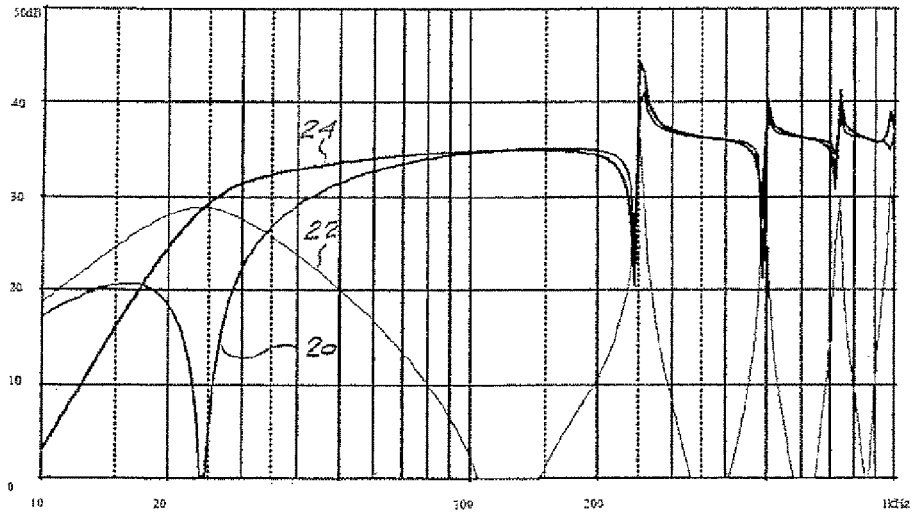
PRIOR ART Fig. 2
FIG. 2 is a frequency response graph illustrating the calculated output of the loudspeaker driver, the port and the summed output of the enclosure of FIG. 1.
Figure 3:
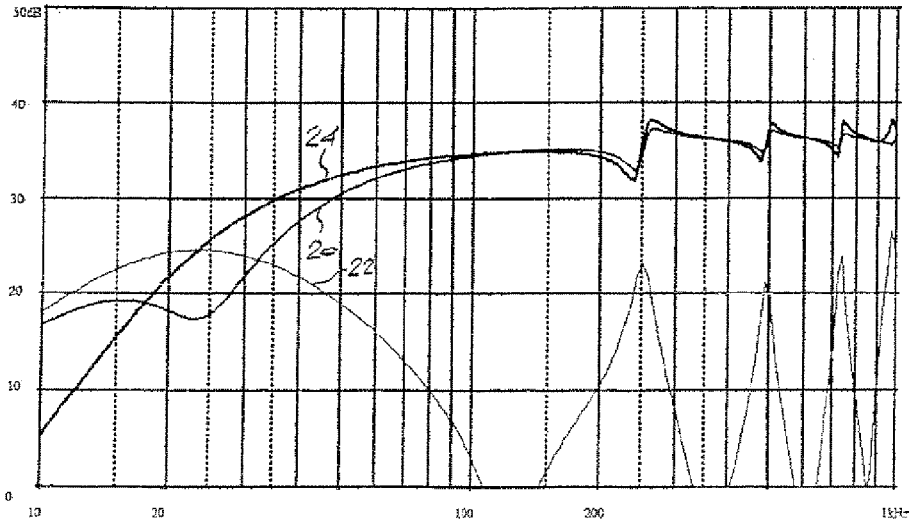
FIG. 3 is a frequency response graph showing the calculated behavior of the enclosure of FIG. 1 with damping material included.

To explain the issues involved, several driver/enclosure arrangements are analysed below in a single dimension, that is to say that lateral modes are not considered. The models assume a driver with a cone diameter of 335 mm and an enclosure volume of 200 liters. FIG. 1 illustrates schematically a conventional ported or vented box arrangement with a driver 10 in one face 12 of an enclosure 14. The enclosure has a depth similar to its width, and has a port 16 in a side wall 18 of the enclosure. The graph of FIG. 2 shows the outputs 20, 22 and 24 of the driver, the port and the summed output, respectively. The effect of the longitudinal enclosure resonances can clearly be seen in the frequency range above 200 Hz. The graph of FIG. 3 shows the effect of adding damping material to the interior of the enclosure. The resonances are reduced in significance but port output also suffers.

Figure 4:
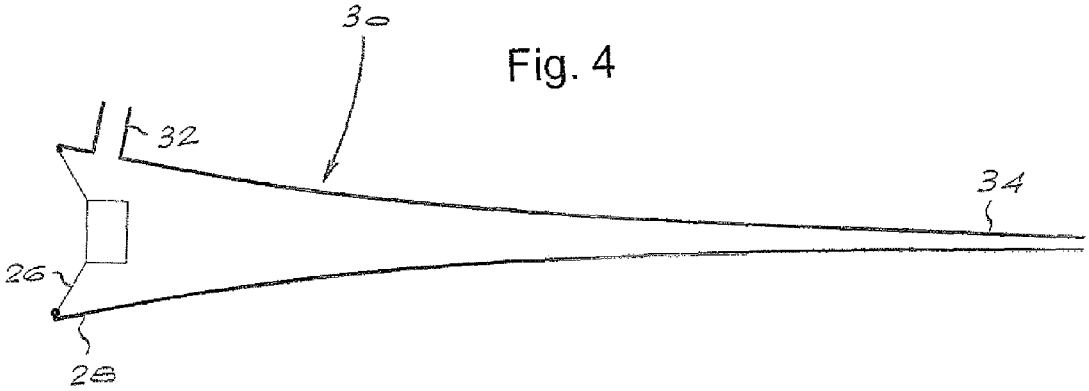
FIG. 4 is a schematic side view of an exponential horn with a driver mounted in the mouth thereof, with a port adjacent the driver.
Figure 5:
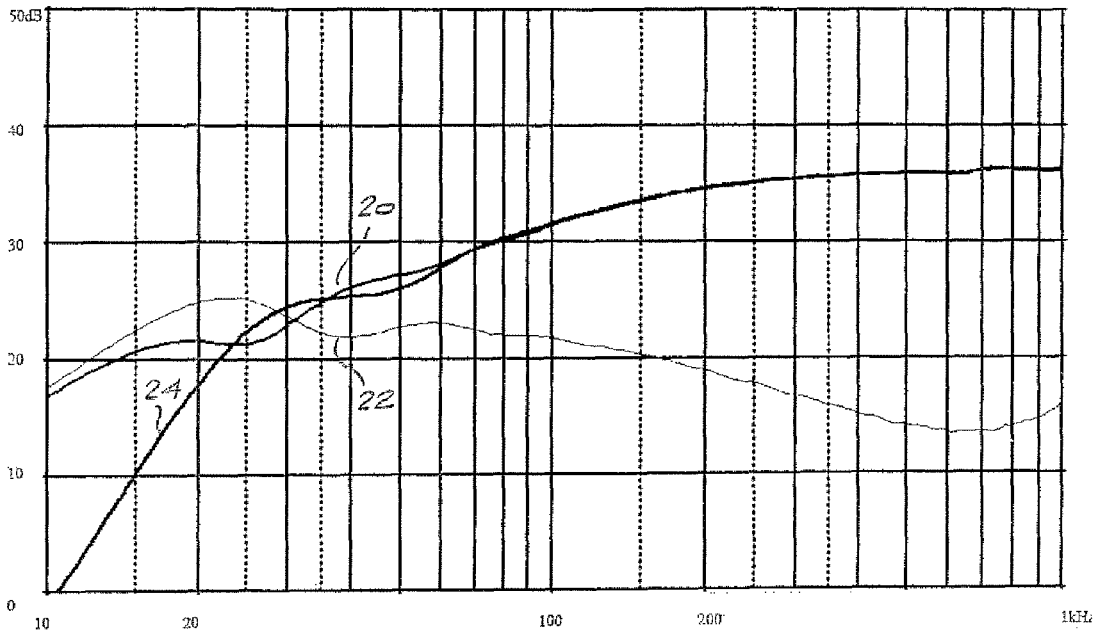
FIG. 5 is a frequency response graph illustrating the calculated performance of the arrangement of FIG. 4.

In the arrangement of FIG. 4 a driver 26 is mounted on the mouth end 28 of an exponential horn 30, having a mouth with a similar diameter to that of the driver. A port 32 connecting the inside of the horn to the outside is positioned adjacent to the driver. The horn cut-off frequency, or flare rate, is selected to give a total volume within the horn identical to that of the reference simple box of FIG. 1 and this results in a cut-off frequency of about half that of the port resonance frequency. Damping (not shown) is added to the horn in a graduated way so that at the driver end it is negligible while at the narrow end 34 of the horn it is considerable. In the corresponding graph of FIG. 5 we see the port output 22 is significantly reduced when compared to that of the simple enclosure of FIG. 1. However, all resonances have been eliminated.

FIG. 6 shows an enclosure which is similar to that of FIG. 4, but in which the cut-off frequency of the exponential horn or tapered tube 30.1 has been raised by increasing its flare rate so that the cut-off frequency is identical to the tuning frequency of the port 32.1. The internal volume of this enclosure has been equalised to the reference enclosure of FIG. 1 by widening the horn at the mouth 28.1 (that is, at the driver end) relative to the enclosure of FIG. 4. The graph of FIG. 7 shows that the port output of this enclosure has improved, compared with the enclosure of FIG. 4, but is still appreciably lower than that of the reference enclosure of FIG. 1. Longitudinal resonance modes are still notably absent.

Figure 8:
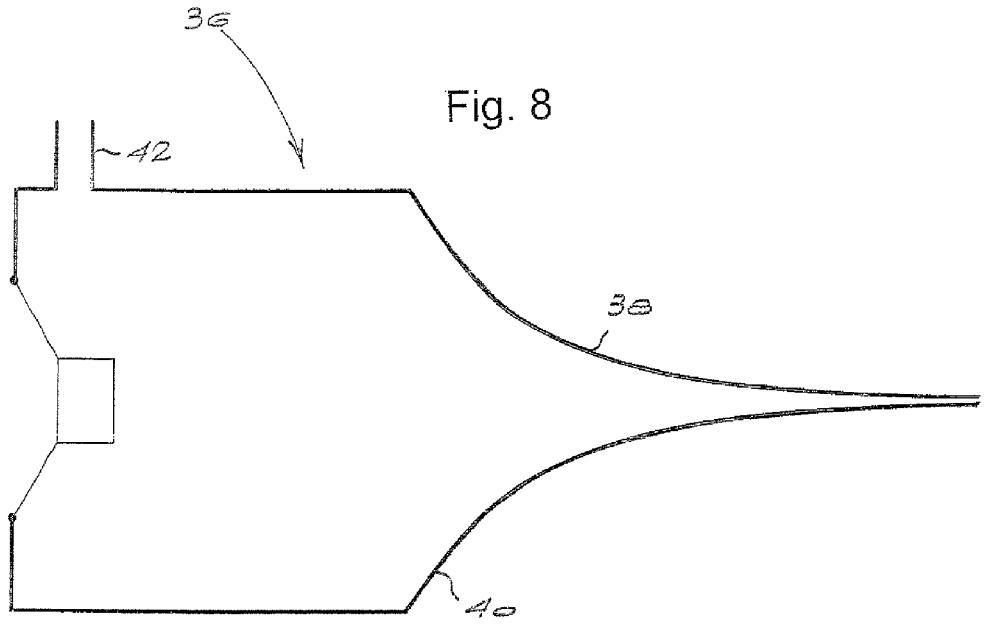
FIG. 8 is a schematic side view of a loudspeaker enclosure according to the invention having a main enclosure with an exponential horn at one end thereof.
Figure 9:
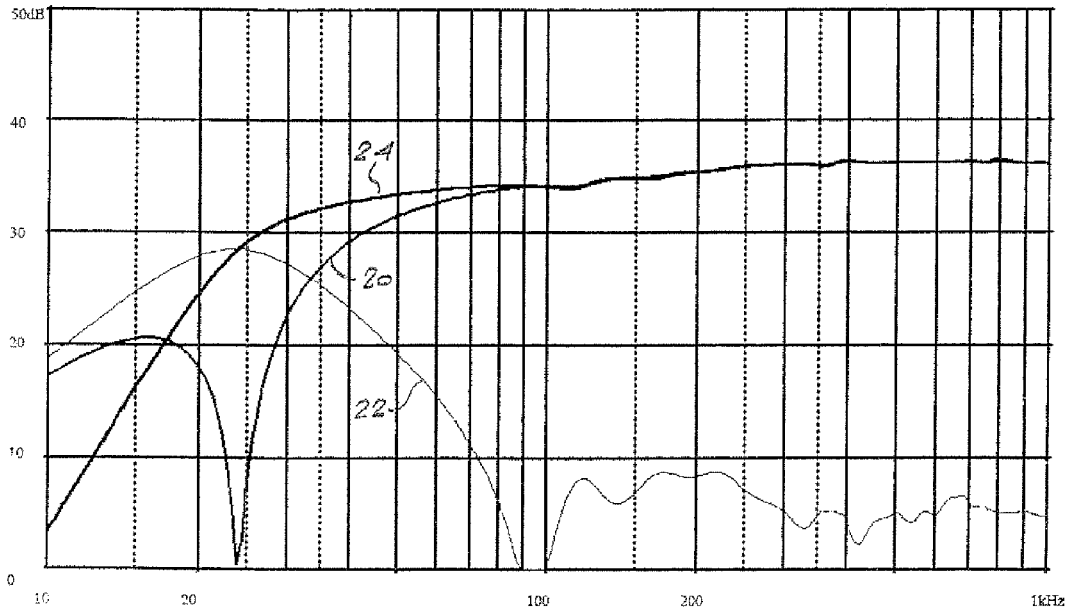
FIG. 9 is a frequency response graph showing the calculated performance of the arrangement of FIG. 8.

FIG. 8 shows an enclosure 36 which is circular in cross section and which is of similar width to the reference enclosure of FIG. 1 but with an exponential horn 38 attached to its rear. The mouth 40 of the horn has the same diameter as the diameter of the main enclosure 36. The horn 38 has a cut-off frequency four times that of the resonant or tuning frequency of the port 42. The graph of FIG. 9 shows that not only are the resonances still absent, but the output 22 has been completely restored relative to the reference enclosure of FIG. 1.

The above analysis demonstrates that by including a correctly designed exponential horn as a sound absorbing element in a ported or vented enclosure, the advantages of a ported enclosure can be obtained together with a reduction in internal standing waves.

Figure 10:
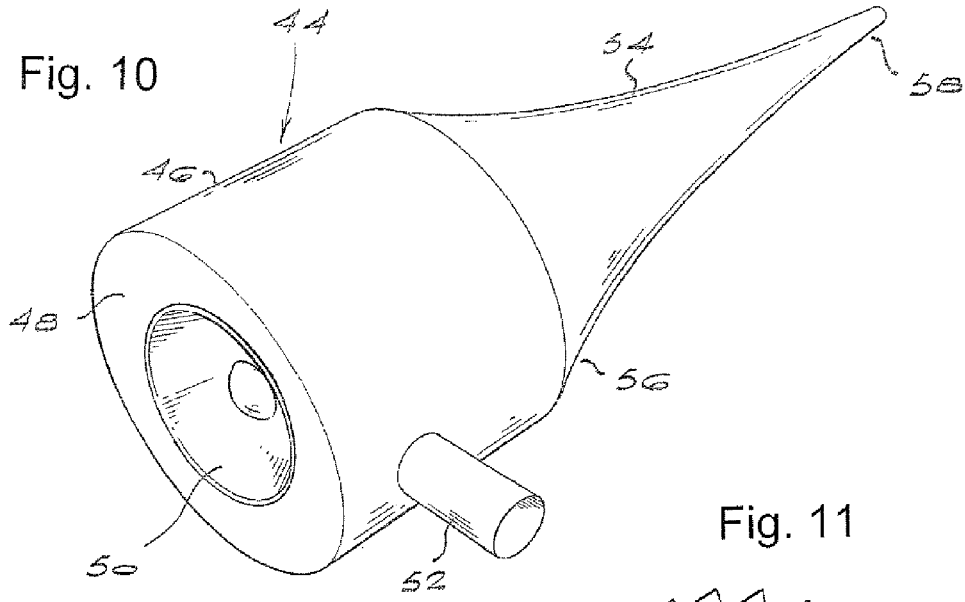
FIG. 10 is a pictorial view of a loudspeaker enclosure corresponding to the schematic view of FIG. 8.

Referring now to FIG. 10, a pictorial view of an enclosure 44 is shown which corresponds to that of FIG. 8. The enclosure has a cylindrical body 46 defining a main enclosure and having a front end face or baffle 48 in which a driver 50 is mounted. A tuned port 52 extends outwardly from the enclosure body 46 and is located between the baffle 48 and the middle of the body, that is, in the half of the main enclosure closest to the driver. Extending from the end of the body 46 remote from the baffle 48 is an exponential horn 54 which has a mouth 56 with the same diameter as that of the body 46. The horn 54 has a cut-off frequency four times that of the resonant or tuning frequency of the port 52. The interior of the horn 54 is preferably filled with absorbent material, the density of which increases towards the outer end 58 of the horn.

The described enclosure can be constructed from a number of materials, including plastics and composite materials. Bent wood might be used to good effect but composite materials such as glass or carbon fibre reinforced resin might give improved performance in a lighter enclosure.

Figure 16:
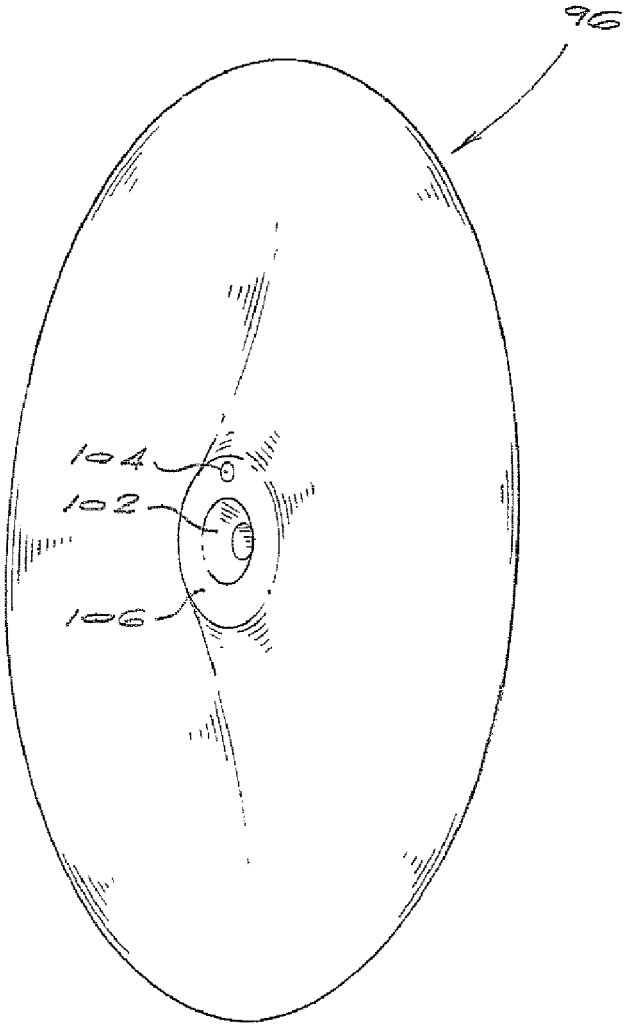
FIGS. 16 & 17 are a pictorial view and a sectional side view, respectively, of an alternative embodiment of a loudspeaker enclosure according to the invention.
Figure 17:
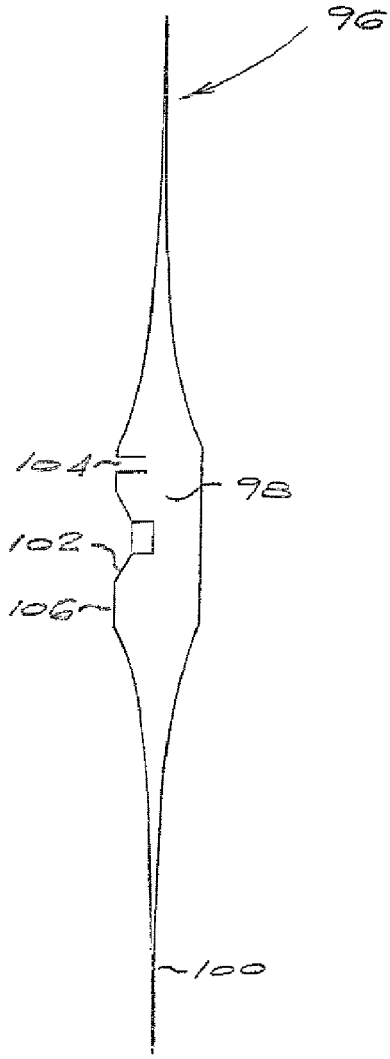

The techniques of the invention can be applied to a number of other enclosure configurations, such as the embodiment of FIGS. 16 and 17. In this embodiment, a disc-shaped loudspeaker enclosure 96 is shown, which has a central main enclosure 98 which is cylindrical and a peripheral region 100 defining an exponential horn. A driver 102 and a port 104 are mounted in one circular face or baffle 106 of the main enclosure. In this embodiment, the mouth of the horn is contiguous with the interior of the main enclosure in a cylindrical transition zone and the horn extends transversely to the longitudinal axis of the cylindrical main enclosure.

Figure 11:
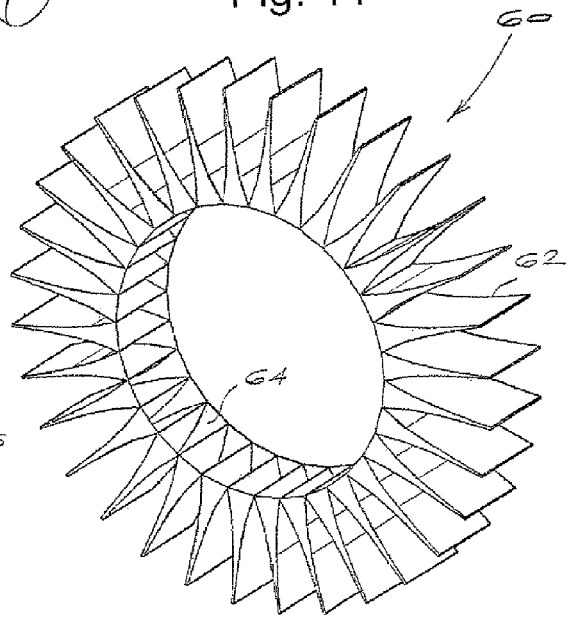
FIGS. 11 & 12 are pictorial views of alternative embodiments of sound absorbing elements usable in the loudspeaker enclosure of FIG. 10 in place of the exponential horn thereof.
Figure 12:
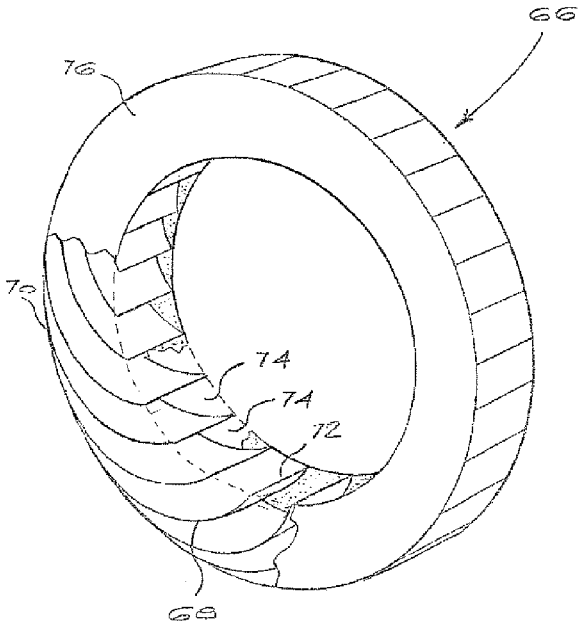

The rather unwieldy arrangement of FIGS. 16 and 17 may be made far more manageable if the single swept horn defined by the peripheral region 100 is replaced with a more compact structure as shown in FIGS. 11 and 12, which show two versions of sound absorbing elements utilising multiple horns. In this case, the horn of FIGS. 16 and 17 is dispensed with, leaving a cylindrical enclosure with a flat (or possibly non-planar) rear end face, and one of the ring-shaped sound absorbing elements shown in FIGS. 11 and 12 is located within the cylindrical enclosure at the periphery thereof.

With reference first to FIG. 11, a ring-shaped sound absorbing element 60 comprises a plurality of small exponential horns 62 arranged circularly, with the mouths 64 of the horns facing the centre of the circle. The cut-off frequency of each horn 62 is preferably at least two times and most preferably at least four times the resonant frequency of the tuned port.

The sound absorbing structure can be constructed from a number of materials including plywood, metals such as aluminium sheet, plastics and composite materials. Advantageously, the structure can be formed as a fibre reinforced plastics moulding.

In the sound absorbing element 66 of FIG. 12 the radially aligned horns 62 of FIG. 11 have effectively been wrapped around the central enclosure in order that the adjacent horns might share partitions and reduce the overall diameter of the structure. The sound absorbing element 66 is formed of a plurality of overlapping sheets 68 of stiff material such as bent wood, fibre reinforced composite or sheet metal which are arranged circumferentially as shown. Each sheet 68 has a first end 70 which overlaps and is glued or otherwise fixed to two or more adjacent sheets at the outer circumference of the element 66, and a second, inwardly curving end 72 which is spaced apart from the inwardly curving ends of adjacent sheets. The curvature of the sheets and the spacing between them defines exponential horns 74 between adjacent sheets, each having a curved axis and with their mouths facing inwardly. Annular end panels 76 of sheet material which, in the case of the modified embodiment of FIGS. 16 and 17 can form the continuation of the baffle and rear of the enclosure, are fixed in place on opposite ends of the sound absorbing element to close the sides of the horns.

The use of the sound absorbing elements 60 or 66 within a main enclosure enables a similar resonance-canceling effect to be obtained as in the case of the enclosures of FIGS. 10 and 16, but in a more conventional-looking enclosure.

The same principle might be applied to an enclosure having a rectangular form, but then requires the use of a number of differently shaped sheets to include the corner areas.

Figure 13:
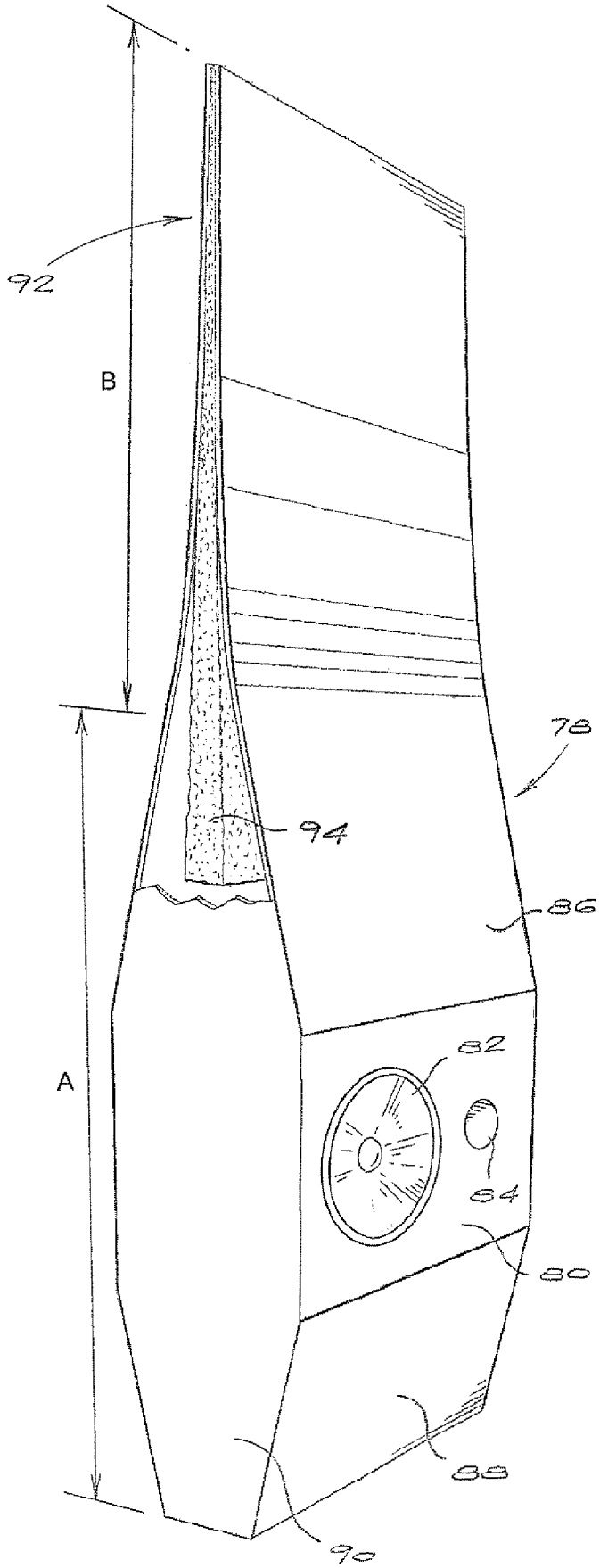
FIG. 13 is a pictorial view of a prototype loudspeaker enclosure of the invention.

The principles of the invention are not limited to use with cylindrical enclosures. FIG. 13 shows a prototype of a more conventional loudspeaker enclosure 78 which is rectangular in plan and which has a main enclosure comprising flat panels of sheet plywood. The enclosure has a rectangular baffle 80 in which a low frequency driver or woofer 82 is mounted. Generally, "low frequency" can be considered to refer to frequencies below 1 kHz, and typically below 250 Hz. A tuned port 84 is located on the baffle 80 adjacent the driver 82. An identical driver and port (not shown) are located on the far side of the enclosure. The ports 84 each have a longitudinal axis which is substantially parallel to an axis extending normal to the aperture in which the driver 82 is mounted and coinciding with a longitudinal axis of the driver itself.

The enclosure has inclined upper and lower panels 86 and 88, front and rear, and a flat base. A pair of opposed end panels 90 define the ends of the enclosure. The upper ends of the end panels 90 and of the upper panels 86 are extended and curved to define an exponential horn 92, which is shown partly cut away. The prototype enclosure 78 defined a main enclosure having a height A of 1150 mm, a width of 350 mm and a depth of 510 mm, with a horn having a length B of 1000 mm. The driver 82 had a cone diameter of 225 mm and a free air resonance of approximately 25 Hz, and the port 84 was also tuned to 25 Hz.

Within the horn 92 is a sheet 94 of acetate fibre matting having a thickness of 50 mm and a width of 500 mm. This was drawn into the horn in such a way that the fibre of the matting was compressed tightly at the narrow end of the horn, but completely free at the widest point. No fibre filling was placed in the main body of the enclosure.

For purposes of comparison, an enclosure having the same dimensions as the primary chamber or main enclosure of FIG. 13, but not including a horn, was also constructed.

Figure 14:
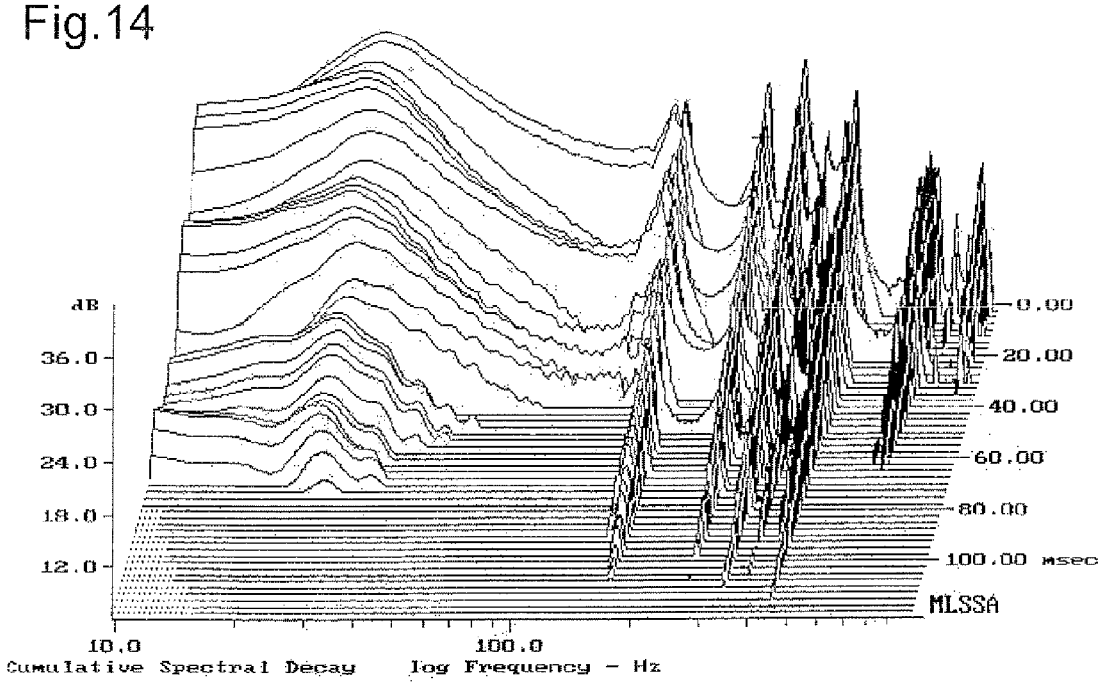
FIGS. 14 & 15 are cumulative spectral decay plots comparing the performance of the enclosure of FIG. 13 with that of a reference enclosure.
Figure 15:
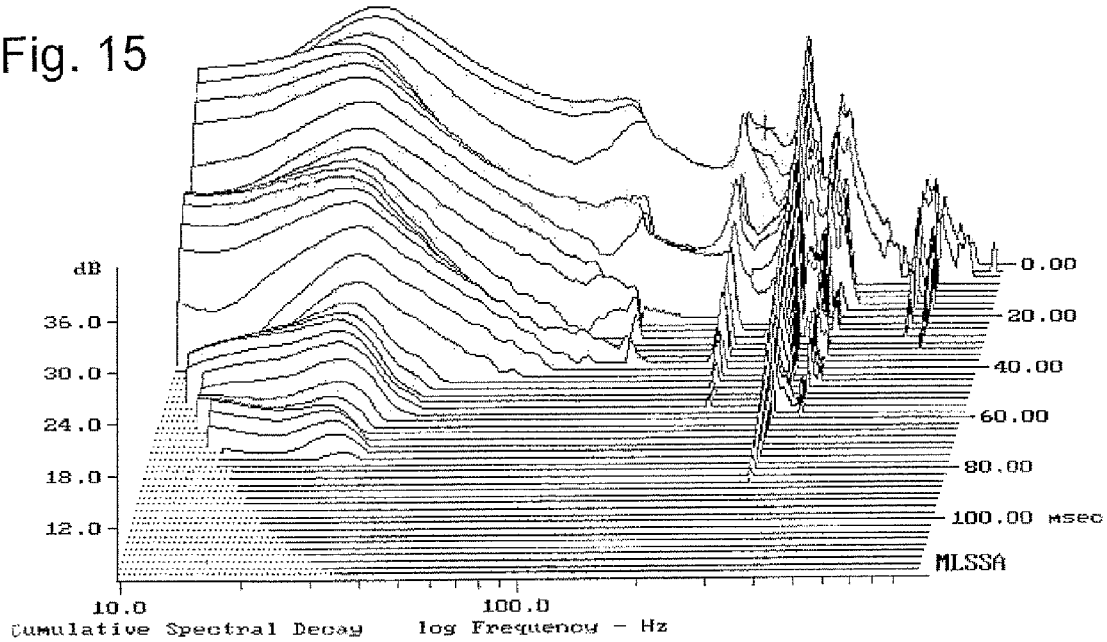

A microphone was placed in the centre of the upper trapezoidal section of the main enclosures, and impulse measurements yielded the cumulative decay spectra shown in FIGS. 14 and 15. Resonant modes are visible as ridges having constant frequency but which decay in level as a function of time. The spectrum of FIG. 14 shows the resonant characteristics of the reference enclosure, while the spectrum of FIG. 15 shows the performance of the enclosure of FIG. 13. In FIG. 15, some of the strong resonances appearing in FIG. 14 have disappeared, in particular the fundamental at 160 Hz. These are the eigentones associated with the longest dimension. The resonances which remain are those involving the depth and width of the enclosure. The port resonance at 25 Hz is substantially unaffected.

Additional treatment of the interior of the enclosure can be applied to control the remaining minor resonances. In particular, one or more auxiliary sound absorbing elements of the invention can be utilised for this purpose. For example, in the case of the enclosure shown in FIG. 10, a combination of the circular horn array of FIG. 11 and the simple horn of FIG. 10, which might itself be replaced by a similar array of smaller horns, would treat all walls of the enclosure except the baffle thereby eliminating standing waves in all directions.

Figure 18:
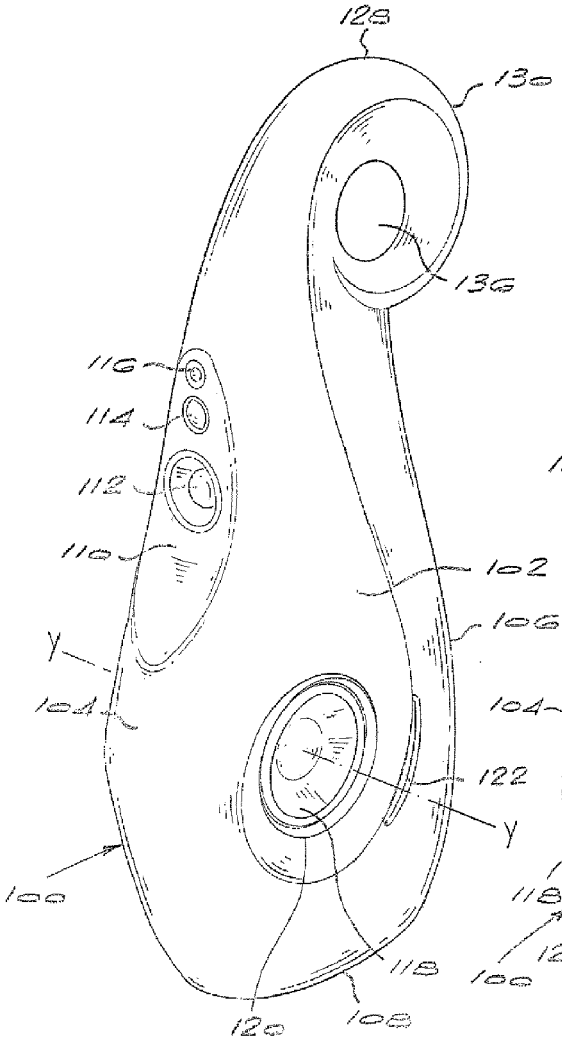
FIGS. 18 to 20 are a pictorial view, external side view and partial sectional internal side view, respectively, of a further alternative embodiment of a loudspeaker enclosure according to the invention.
Figure 19:
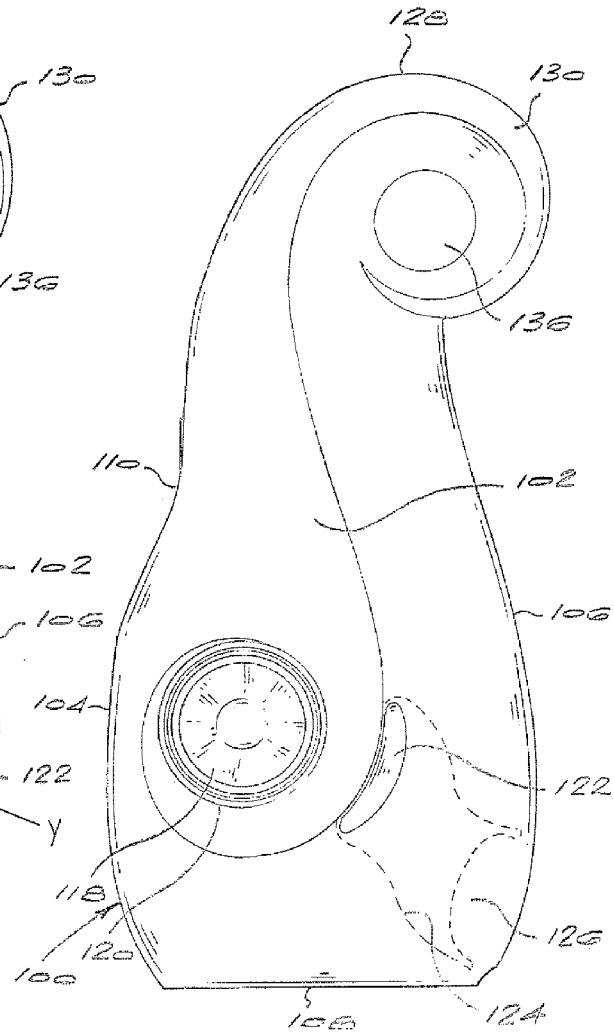
Figure 20:
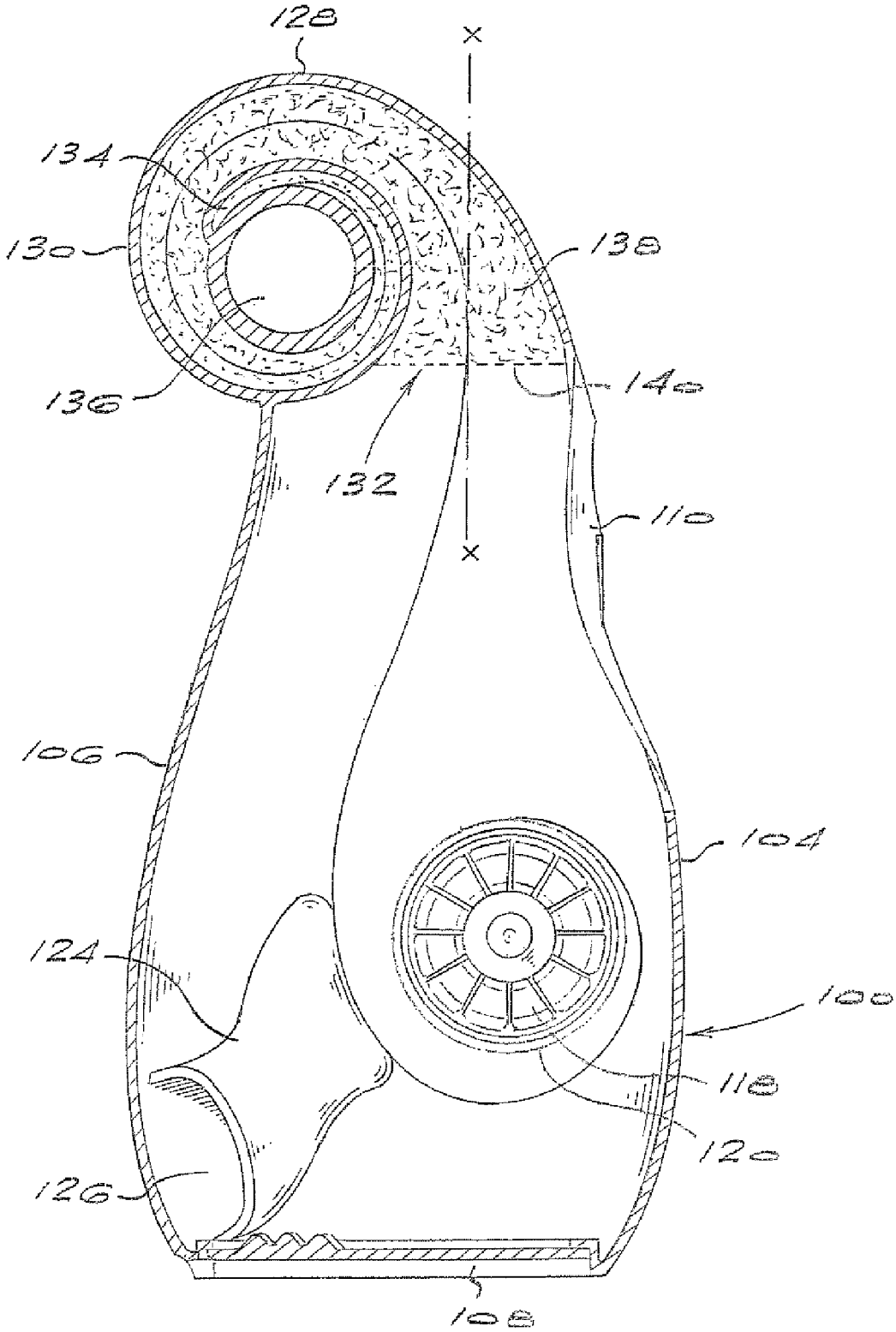

A further embodiment of a loudspeaker enclosure according to the invention is shown in FIGS. 18, 19 and 20. The enclosure 100 is moulded from a material such as GRP (glass reinforced polyester), glass fibre and resin, or another mouldable material capable of providing the required strength, rigidity and other necessary structural properties.

The enclosure 100 has curved outer surfaces which merge into one another, including major side surfaces 102, a front surface 104 and a rear surface 106. The enclosure has a flattened base surface 108. In plan, the cross-section of the enclosure 100 is generally ellipsoidal, but varies in its dimensions and area with height. This in itself tends to reduce the development of standing waves within the enclosure.

A baffle 110 is defined in the front surface 104, which has an upper portion which is substantially flat and in which three drive units 112, 114 and 116 are mounted. In each of the major side surfaces 102 a low frequency or bass driver 118 is mounted in an opening 120, facing to the side. Adjacent each bass driver is a port which has an elongated kidney-shaped external opening 122, and which is defined by a tunnel 124 on the inner surface of the respective major side wall 102, with an internal opening 126 within the enclosure. The external opening 122 is aligned generally concentrically with the bass driver 118 and its aperture 120. The tunnel is moulded from the same material as the main body of the enclosure.

It can be noted that the external opening 122 of the port is closer to the bass driver 128 than the internal opening 126, due to the fact that the tunnel 124 defining the port extends generally radially away from the bass driver 118 and its associated opening 120. The general direction of alignment of the port, or the longitudinal axis of the port, is thus transverse to an axis extending normal to the aperture 120 and coinciding with a longitudinal axis of the bass driver 118 itself. The port in this embodiment was tuned to 23 Hz, while the bass drivers used also had a fundamental free-air resonance of 23 Hz.

Towards the upper end 128 of the enclosure, the cross section of the enclosure reduces substantially and it defines a coiled exponential horn 130 with a mouth 132 facing downwardly towards the base of the enclosure. The horn 130 is wrapped around itself spirally so that the end 134 of the horn is within and adjacent to an intermediate portion of the horn, thus defining an aperture 136 about which the horn coils. This imparts a distinctive appearance to the enclosure but also serves to accommodate the length of the horn within a relatively compact volume.

The horn is filled with absorbent material 138 which can be retained in place, if necessary, by a grille or mesh 140. The absorbent material has a density which increases towards the far end 134 of the horn. The absorbent material can comprise materials such as acetate fibre, glass fibre or wool, or other materials having suitable acoustically absorbent properties.

It can be seen that the mouth 132 of the horn is substantially further away from the internal opening 126 of the port in the enclosure, and in this embodiment the longitudinal axis X-X of the horn at its mouth is upright and extends transversely to the longitudinal axis Y-Y (that is, the axis of movement of the voice coils of the low frequency drivers 118). The cut-off frequency of the horn in this embodiment was 100 Hz, just over four times the port resonance frequency.

From the description of the embodiments above, it can be seen that by utilising one or more sound absorbing elements comprising exponential horns, having a cut-off frequency with a predetermined relationship to the port resonance of a ported or vented loudspeaker enclosure, it is possible to control standing waves in such an enclosure without adversely affecting the port characteristics. Consistently with the described embodiments, it is generally preferred that the port of the enclosure is formed in a primary chamber of the enclosure, outside or beyond the mouth of the sound absorbing horn or horns. Various geometries are possible, depending on a number of factors including cost, size, performance requirements, enclosure material and construction, and styling considerations.

The invention claimed is:

1. A ported loudspeaker enclosure having a first aperture in which a driver can be mounted, the driver having a first resonant frequency; a second aperture defining a port extending between the interior and the exterior of the enclosure, the port being tuned to a second resonant frequency; and a sound absorbing element comprising at least one horn having a mouth in communication with the interior of the enclosure, and said at least one horn having a cut-off frequency equal to or greater than the resonant frequency of the port, wherein said at least one horn is positioned so that rear radiation from the driver enters the mouth of said at least one horn and is attenuated within said at least one horn.

2. The ported loudspeaker enclosure according to claim 1 wherein said at least one horn has a cut-off frequency which is at least twice the resonant frequency of the port.

3. The ported loudspeaker enclosure according to claim 2 wherein said at least one horn has a cut-off frequency which is at least four times the resonant frequency of the port.

4. The ported loudspeaker enclosure according to claim 1 wherein said at least one horn of the sound absorbing element is defined by an external wall or walls of the enclosure which converge according to a predetermined function.

5. The ported loudspeaker enclosure according to claim 4 wherein the enclosure has a wall or walls defining a tapered structure of circular or rectangular cross section.

6. The ported loudspeaker enclosure according to claim 4 wherein the enclosure is circular or part-circular, with walls converging radially outwardly to define a disc-shaped or part-disc-shaped enclosure with a cross section that reduces towards an outer edge thereof.

7. The ported loudspeaker enclosure according to claim 1 wherein said at least one horn of the sound absorbing element is defined by one or more structures positioned within the enclosure.

8. The ported loudspeaker enclosure according to claim 7 wherein the sound absorbing element comprises at least one structure defining a plurality of individual horns arranged in a ring or planar configuration.

9. The ported loudspeaker enclosure according to claim 1 wherein the second aperture defining the port is located adjacent to the first aperture in the enclosure, with a longitudinal axis substantially parallel to an axis extending normal to the first aperture.

10. The ported loudspeaker enclosure according to claim 9 wherein the first aperture and the second aperture are both formed in a common baffle of the enclosure in which at least one drive unit can be mounted.

11. The ported loudspeaker enclosure according to claim 1 wherein the second aperture defining the port has a longitudinal axis extending transversely to an axis extending normal to the first aperture.

12. The ported loudspeaker enclosure according to claim 1 wherein the second aperture defining the port is formed in a primary chamber of the enclosure outside the mouth of said at least one horn.

13. The ported loudspeaker enclosure according to claim 12 wherein the second aperture defining the port is located closer to the first aperture than to the mouth of said at least one horn.

14. The ported loudspeaker enclosure according to claim 1 wherein the horn is coiled spirally.

15. The ported loudspeaker enclosure according to claim 14 wherein the horn has a longitudinal axis at the mouth thereof which extends transversely to an axis extending normal to the first aperture.

16. A loudspeaker comprising a ported loudspeaker enclosure according to claim 1 and at least one driver.

17. The ported loudspeaker enclosure according to claim 1 wherein at least a part of said at least one horn is tapered exponentially.

* * * * *